United States Patent [19]

Dover

[11] Patent Number: 4,579,178

[45] Date of Patent: Apr. 1, 1986

[54] GRADER ATTACHMENT FOR TRACTORS

[76] Inventor: Gary H. Dover, 19839 Floyd, Stilwell, Kans. 66085

[21] Appl. No.: 619,122

[22] Filed: Jun. 11, 1984

[51] Int. Cl.[4] ..... E02F 3/76

[52] U.S. Cl. ..... 172/297; 172/478; 172/459

[58] Field of Search ..... 172/797, 781, 815, 477, 172/476, 478, 459, 297, 303, 305, 295

[56] References Cited

U.S. PATENT DOCUMENTS

| | | | |
|---|---|---|---|
| 2,601,380 | 6/1952 | Flory | 172/297 X |
| 2,630,052 | 3/1953 | Jory | 172/305 |
| 2,754,740 | 7/1956 | Kirby | 172/478 |
| 2,882,978 | 4/1959 | Smith | 172/305 |
| 3,148,466 | 9/1964 | Batko | 172/781 |
| 3,445,944 | 5/1969 | Speno | 172/459 X |
| 3,698,487 | 10/1972 | Ruth | 172/781 |
| 4,063,597 | 12/1977 | Day | 172/126 |
| 4,332,299 | 6/1982 | Parks | 172/305 |
| 4,466,491 | 8/1984 | Tower | 172/476 |

*Primary Examiner*—Richard J. Johnson

*Attorney, Agent, or Firm*—Kokjer, Kircher, Bradley, Wharton, Bowman & Johnson

[57] ABSTRACT

A grader attachment for tractors includes a support designed to be secured to the frame of the tractor intermediate the front and rear wheels and projecting laterally from the tractor. An arm is pivotally coupled intermediate its ends to the support for swinging through a vertical arc. A tiltable mounting head pivotally secures a grading blade to the outermost end of the arm and the components of the attachment are arranged so that the arm and components carried thereby can be swung to a near vertical position for clearing obstacles such as may be encountered in landscaping operations.

3 Claims, 5 Drawing Figures

GRADER ATTACHMENT FOR TRACTORS

This invention relates to graders, and more particularly to a grader attachment adapted to be mounted on a tractor for use in ground leveling and similar operations.

Attachments for tractors for performing a variety of operations, including for grading, have heretofore been proposed. Such attachments have received general acceptance and many of them are highly versatile devices. They are particularly useful in connection with the ground leveling and smoothing operations carried out in landscaping work. Such activities are ordinarily of a nature that the use of heavier track laying equipment such as bulldozers and the like are not required. Often such heavy equipment would not be sufficiently maneuverable for effective use and could cause damage, which would offset any productive use which might be obtained.

Heretofore available grading attachments for landscaping work have had several drawbacks. It is desirable that such attachments project laterally from the tractor intermediate the tractor wheels so that the tractor operator can carefully observe the grading action as it is carried out. Such close observation is often required because of the necessity to taper and blend the ground surface with adjacent surface areas, particularly during repair work to damaged sodded areas or to areas containing established shrubbery.

Landscaping operations are often carried out among growing trees and fixed impediments to movement of the equipment over the working terrain. Tractors equipped with conventional grader attachments projecting laterally from the tractor have substantially increased overall width rendering the machine difficult, if not impossible to maneuver between obstacles of this kind. Such lack of maneuverability has detracted from the use which might be made of these items of equipment.

Accordingly, it is a primary object of the present invention to provide a grader attachment for a tractor which projects laterally therefrom, yet which may be quickly and easily moved to a position providing no substantial obstacle for the tractor to move between relatively closely spaced obstacles.

Another object of this invention is to provide such an attachment which can be quickly and easily returned to its working position after the tractor has cleared an obstacle.

A further object of the present invention is to provide in the construction of the attachment a novel arrangement of parts wherein conventional fluid and cylinder assemblies having relatively short strokes may be utilized to produce relatively greater movement of the grader blade, thereby obviating the need for expensive, specially constructed components to swing the blade between its working and standby, obstacle clearing positions.

These and other important aims and objectives of the present invention will be further explained or will become apparent from the following description of the drawings, wherein.

Figure 2:
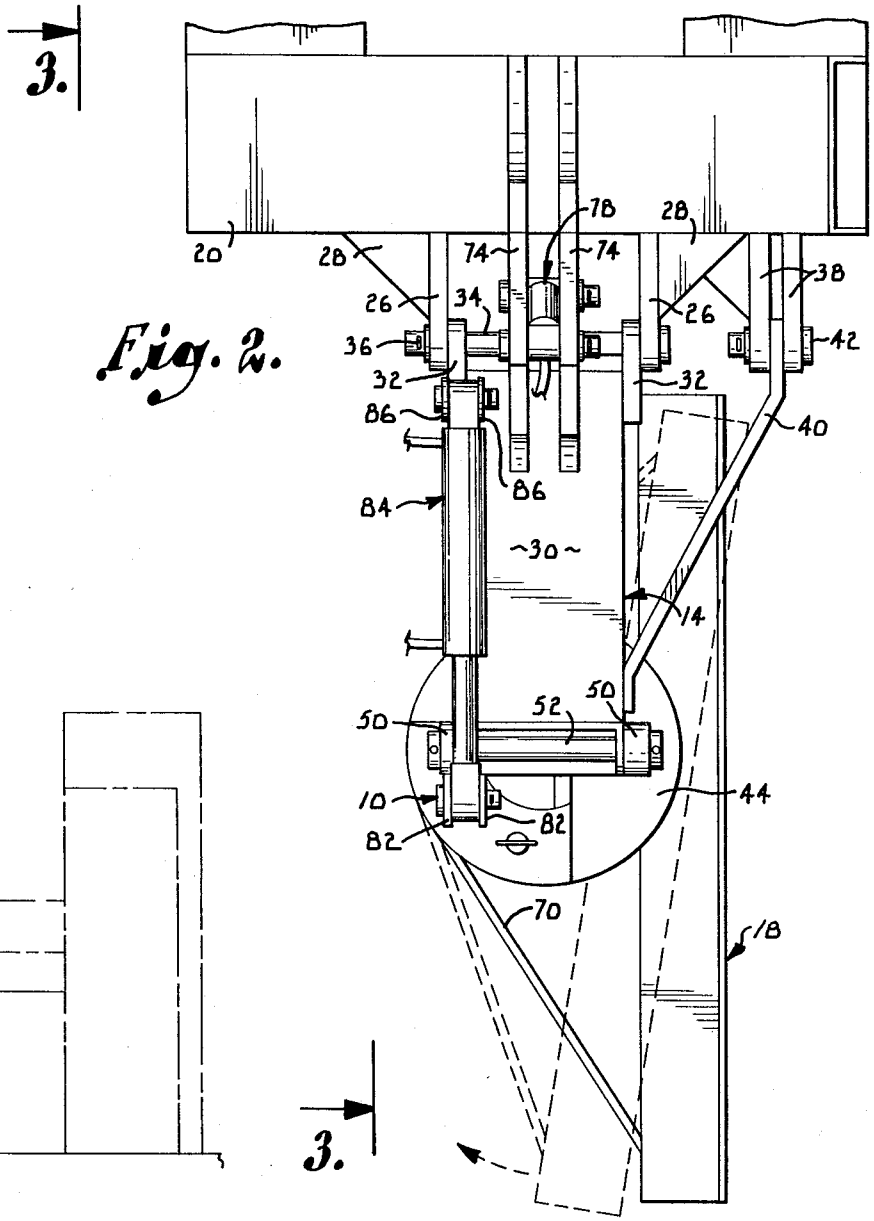
FIG. 2 is a top plan view on an enlarged scale of the attachment.

A grader attachment embodying the principles of this invention is broadly designated by the reference numeral 10. Attachment 10 includes a support 12, an elongated, rigid arm 14, a mounting head 16 and a grader blade assembly 18.

Support 12 includes an elongated, rigid structural member 20 adapted to be attached in a fore and aft extending position to a frame component 22 of a wheeled tractor 24 intermediate the front and rear wheels of the tractor. Member 20 can be bolted to the tractor frame or, if desired, welded thereto.

A pair of spaced apart, outwardly projecting, parallel ears 26 are secured to the outer edge of member 20 by welding or the like. For enhanced strength, each ear 26 is supported by a gusset 28 secured to the corresponding ear and outer edge of member 20 respectively.

Arm 14 comprises a relatively wide, elongated sturdy beam 30 having a pair of parallel spaced apart ears 32 secured to the beam and projecting from one end of the latter in disposition to fit between the projecting ears 26 of support 12. Arm 14 is pivotally coupled to support 12 by means of a pin 34 extending through aligned holes in the respective ears and secured by cotter pin means 36. Pin 34 extends in general parallelism with member 20 and is in horizontal position in general alignment with tractor 24.

For increased stability to arm 14, a pair of spaced apart ears 38 are rigidly secured to member 20 forwardly of beam 30 as shown best in FIG. 2 of the drawing. An angled brace 40 is pivotally secured to the ears 30 by a pin 42 axially aligned with pin 34. The pivot axis of swinging of arm 14 with respect to support 12 is about the axis defined by the aligned pins 34 and 42.

Mounting head 16 includes a pair of round discs 44 and 46 held in superposed, spaced apart parallelism by a vertically extending web 48 welded between the discs. Upwardly extending, parallel spaced apart projections 50 secured to upper disc 44 pivotally couple mounting head 16 to the outermost end of beam 30 by means of a pin 52 received between aligned holes in projections 50 and in the outermost end of beam 30. Pin 52 extends parallel to the axis of pivotal coupling of arm 14 to support 12.

Figures 3, 4:
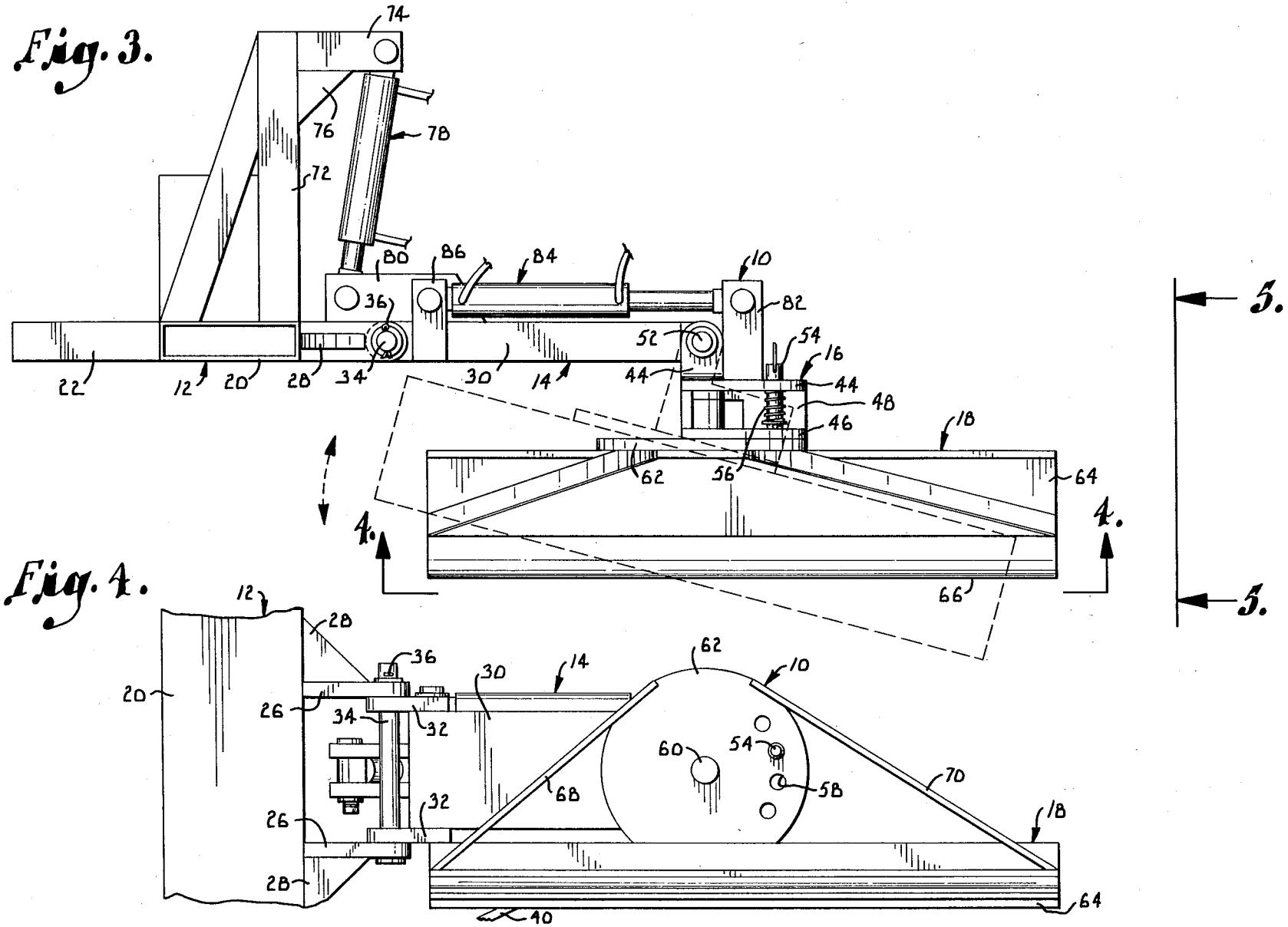
FIG. 3 is a rear elevational view of the attachment of FIG. 2, an angled position of the blade being shown in dash lines.
FIG. 4 is a detailed view taken along line 4—4 of FIG. 3.

A vertically extending latch pin 54 is mounted in aligned holes of the discs 44 and 46 as shown best in FIG. 3 of the drawing. A spring 56 is telescoped over pin 54 and secured thereto in a manner to bias the pin into a downward position projecting into a selected one of a series of spaced apart holes 58 extending concentrically with a central axle 60 mounting a circular plate 62 in abutting relationship with the lower surface of disc 46. This arrangement permits the plate to be pivoted around axle 60 when pin 54 is pulled upwardly against the bias of spring 56 to a position wherein the lowermost end of the pin is not projecting into any of the holes 58. Spring 56 moves the pin to project into whichever of the holes is aligned thereunder when the pin is released. This locks plate 62 against pivoting movement with respect to disc 46.

Figure 5:
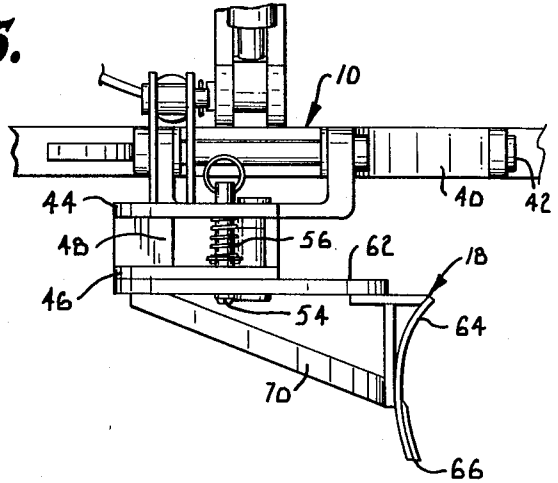
FIG. 5 is a detailed view, on a reduced scale, taken along line 5—5 of FIG. 3.
Figure 1:
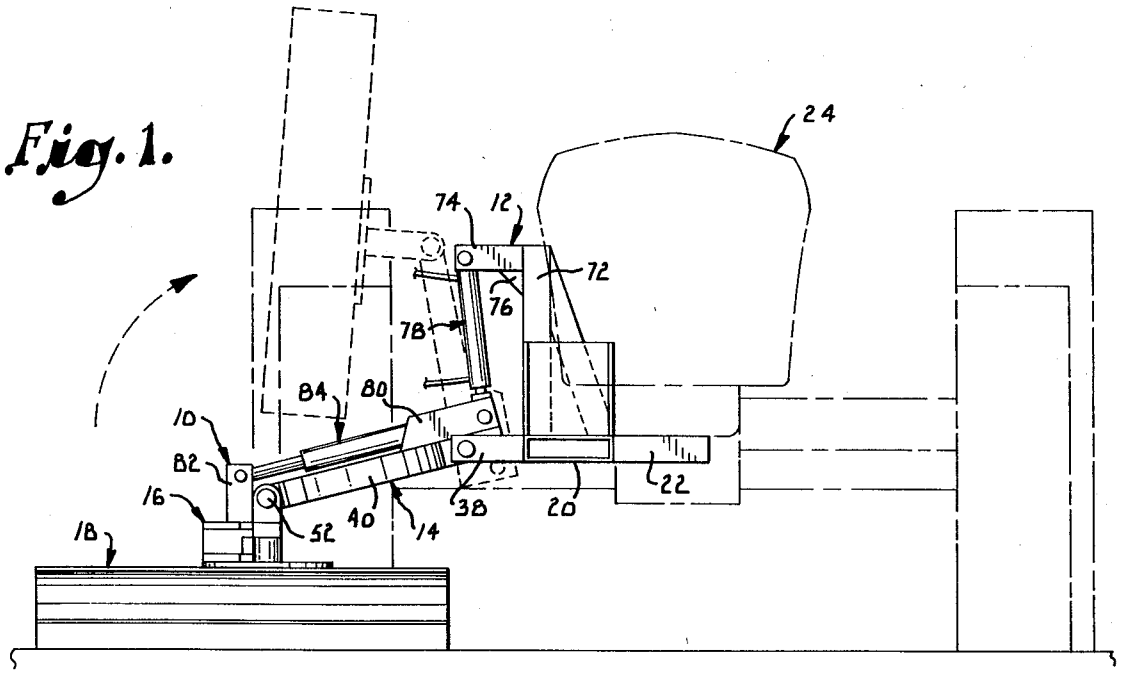
FIG. 1 is a front elevational view of an attachment embodying the principles of this invention, a tractor being shown in broken lines to show the relative position of the attachment mounted thereon, a partially retracted position of the attachment being shown in dash lines.

Plate 62 comprises an integral part of the attachment blade assembly 18. In this regard, an elongated, preferably transversely curvilinear, rigid grader blade 64 having a lowermost straight ground engaging edge 66 is rigidly secured to plate 62 as illustrated best in FIG. 5 of the drawing. A pair of elongated rigid struts 68 and 70 are secured to the outer ends of blade 64 and to plate 62 respectively to stabilize the blade.

Means for swinging arm 14 and the components carried thereby through a vertical arc about the axis of pin 34 includes an elongated, rigid upright standard 72 secured to the uppermost surface of member 20. Spaced apart, outwardly projecting legs 74 cantilevered from the upper end of standard 72 and rigidly secured in such position by gusset means 76 is pivotally coupled to one end of a conventional, double acting fluid piston and cylinder assembly 78 adapted to be coupled with the engine driven hydraulic system of tractor 24. The piston rod of assembly 78 is pivotally coupled to an extension 80 of beam 30 in the form of a pair of parallel, spaced apart plates welded to the upper surface of the beam.

It should be pointed out that the point of pivotal connection of assembly 28 to extension 80 is spaced inboard of the axis of swinging movement of arm 14 a relatively short distance compared to the distance from the axis to the point of pivotal coupling of mounting head 16 to the outer end of the arm. The arrangement should be such that the longer portion of arm 14 be at least five times greater than the shorter portion thereof and preferably about seven times the length of the shorter portion. This insures that the relatively short stroke of conventional fluid piston and cylinder assemblies can be utilized for swinging the blade through an arc to a near vertical position and at least sufficiently far to bring the blade inboard of the outer edge of the tractor wheels when the latter are in normal working positions.

Means for tilting the blade about a horizontal axis include a pair of upwardly extending flanges 82 welded to the upper surface of plate 44 in spaced apart parallelism. Flanges 82 receive therebetween and are pivotally connected to the piston rod of a fluid piston and cylinder assembly 84. The opposite end of assembly 84 is pivotally coupled to upright flanges 86 rigidly secured to beam 30 as shown best in FIGS. 2 and 3 of the drawing. Assembly 84 is also of the double acting type and is adapted to be operably connected with the hydraulic system of the tractor so that the operator may tilt the blade in any desired direction. Assembly 84 is disposed generally parallel with and in close relationship to the upper surface of beam 30 while assembly 38 is disposed in near vertical disposition. This arrangement provides the clearance necessary to permit the swinging movement to bring the blade to a near vertical position when it is desired to maneuver the tractor through closely spaced obstacles.

Blade 66 can be manually moved to whatever angled position may be considered optimum for the particular grading operation for which the attachment is to be used. This can be accomplished by lifting pin 54 and rotating plate 62 about axle 60 until a desired hole 58 is positioned beneath the pin. Release of the pin from its withdrawn position permits the pin to project downwardly into the aligned hole, releasably locking the blade in the angled position.

The operation of the attachment of this invention is apaprent from the foregoing description. The operator swings arm 14 to the working position by manipulating assembly 78 from the hydraulic system controls on the tractor. The angle of inclination of the blade is also controlled in this manner by assembly 84. When, however, the operator must maneuver the tractor past obstacles which cannot be cleared with the attachment in its extended position, he simply swings the attachment to whatever angle of upward inclination of arm 14 as may be necessary to clear the obstacle. If the obstacle is a relatively high tree, or the like, assembly 78 may be operated to move the arm 14 to a substantially vertical position wherein the clearance required for the equipment is merely that which would be necessary for the width of the tractor alone. The capability for quickly and conveniently moving the arm to the obstacle clearing position and returning it to its working position renders the attachment of this invention a tool which may be used for operations on terrain having substantially more obstacles than terrain which can be advantageously traversed by heretofore known attachments for this general purpose.

Landscaping and grading work often involves maneuvering the grading equipment over relatively rough terrain, ditches, rocks, curbs and the like. This means that the ground clearance of the tractor and the equipment mounted thereon must have sufficient ground clearance to insure that the tractor is not subject to "high centering" and the mounted equipment is not exposed to damage. It is pointed out that the construction of the attachment of this invention is such that the hydraulic cylinders and hydraulic lines which power the attachment are located at a higher elevation than the bulk of the attachment itself. This contruction assures that all parts of the attachment are kept clear of obstructions when the blade is elevated to its uppermost position.

It should also be noted that the blade may be swung about axle 60 when the attachment is in its raised position to dispose the longitudinal blade axis generally horizontally. This blade position, inboard of the proximal tractor rear wheel, minimizes clearance requirements to no more than is required for the tractor itself. It also minimizes the obstruction to the vision required by the tractor operator for most types of tractor work.

Having described the invention, what is claimed is:

1. A mobile earth leveling apparatus suitable for landscaping operations which involve maneuvering between relatively closely spaced apart obstacles, said apparatus comprising:

an engine driven tractor having a frame, front and rear wheels supporting the frame, and an engine driven hydraulic power system;

a support rigidly attached to the tractor frame intermediate said front and rear wheels and projecting laterally from the frame;

an elongated, rigid arm pivotally coupled to the support at a point intermediate the ends of the arm and inboard of the tractor wheels for swinging through a substantially vertical arc, said arm projecting laterally from the tractor frame and extending outwardly beyond the tractor wheels between the front and rear wheels when the arm is in its earth leveling position;

grader means secured to the arm in outwardly spaced relationship from said pivot point;

a fluid piston and cylinder assembly operably coupled with the tractor hydraulic system for operation thereby, said assembly being pivotally coupled to said support and to said arm inboard of the point of pivotal attachment of the arm to the support for selective swinging of the arm between said earth leveling position to a standby position with the arm extending upwardly to minimize the overall width of said apparatus for maneuver between said obstacles;

said piston and cylinder assembly being disposed in a generally upright position, whereby downward elongation of the assembly causes upward swinging of the grader means;

said grader means including a blade, said blade being pivotally mounted on the arm for swinging movement about an axis parallel with the axis of swinging movement of the arm with respect to the support; and said apparatus including power means coupled with the arm and blade respectively for selectively swinging the latter about said axis.

2. The apparatus of claim 1, and said apparatus including means coupling the blade to the arm for swinging movement about an axis substantially normal to the axis of coupling parallel with the axis of swing of the arm with respect to the support.

3. The apparatus of claim 2, and including means for releasably securing the blade in any of a plurality of angular positions about said normal axis.

* * * * *